US010140948B2

(12) United States Patent
Xie

(10) Patent No.: US 10,140,948 B2
(45) Date of Patent: Nov. 27, 2018

(54) METHOD FOR ADJUSTING DRIVING VOLTAGE, RELATED ADJUSTING DEVICE AND DISPLAY DEVICE

(71) Applicant: BOE TECHNOLOGY GROUP CO., LTD, Beijing (CN)

(72) Inventor: Hongjun Xie, Beijing (CN)

(73) Assignee: BOE TECHNOLOGY GROUP CO., LTD, Beijing (CN)

( * ) Notice: Subject to any disclaimer, the term of this patent is extended or adjusted under 35 U.S.C. 154(b) by 30 days.

(21) Appl. No.: 15/324,565

(22) PCT Filed: Jul. 1, 2016

(86) PCT No.: PCT/CN2016/088180
§ 371 (c)(1),
(2) Date: Jan. 6, 2017

(87) PCT Pub. No.: WO2017/117936
PCT Pub. Date: Jul. 13, 2017

(65) Prior Publication Data

US 2018/0033392 A1 Feb. 1, 2018

(30) Foreign Application Priority Data

Jan. 4, 2016 (CN) ..... 2016 1 0004275

(51) Int. Cl.
*G09G 5/00* (2006.01)
*G09G 3/36* (2006.01)

(52) U.S. Cl.
CPC ..... *G09G 5/003* (2013.01); *G09G 3/3648* (2013.01); *G09G 3/3677* (2013.01);
(Continued)

(58) Field of Classification Search
CPC ..... G09G 5/003; G09G 2320/0693; G09G 2330/12; G09G 2310/0267; G09G 2330/021
See application file for complete search history.

(56) References Cited

U.S. PATENT DOCUMENTS 9,354,458 B2 5/2016 Chang et al.
2009/0207106 A1 8/2009 Mizukoshi et al.
(Continued)

FOREIGN PATENT DOCUMENTS

CN 1396767 A 2/2003
CN 1452151 A 10/2003
(Continued)

OTHER PUBLICATIONS

State Intellectual Property Office of the P.R.C. (SIPO) Office Action 1 for 201610004275.1 dated Jun. 28, 2017 20 Pages.
(Continued)

*Primary Examiner* — Adam R Giesy
(74) *Attorney, Agent, or Firm* — Anova Law Group, PLLC

(57) ABSTRACT

The present disclosure provides a method for adjusting gate driving voltages for a gate driving circuit, output terminals of the gate driving circuit being connected with gate lines, an input terminal of the gate driving circuit being connected with a propel link gate (PLG) wiring. The method includes determining a voltage-drop value at an electrical connection point along the PLG wiring with respect to an input terminal of the PLG wiring, the electrical connection point connecting an input terminal of the gate driving circuit with the input terminal of the PLG wiring; and compensating the gate driving voltage on the input terminal of the gate driving circuit based on the voltage-drop value.

9 Claims, 7 Drawing Sheets

(52) U.S. Cl.
CPC ..... *G09G 2310/0267* (2013.01); *G09G 2320/0223* (2013.01); *G09G 2320/0693* (2013.01); *G09G 2330/021* (2013.01); *G09G 2330/12* (2013.01)

(56) References Cited

U.S. PATENT DOCUMENTS

| | | | | |
|---|---|---|---|---|
| 2012/0081410 | A1 | 4/2012 | Yeo et al. | |
| 2012/0249514 | A1 | 10/2012 | Ahn | |
| 2013/0148061 | A1* | 6/2013 | Wang | G02F 1/134309 349/106 |
| 2015/0187801 | A1* | 7/2015 | Xu | H01L 22/32 257/48 |
| 2016/0125807 | A1 | 5/2016 | Wang | |
| 2016/0260381 | A1 | 9/2016 | Gai et al. | |
| 2017/0011699 | A1 | 1/2017 | Wang | |

FOREIGN PATENT DOCUMENTS

| | | | |
|---|---|---|---|
| CN | 1705000 | A | 12/2005 |
| CN | 101520982 | A | 9/2009 |
| CN | 202771779 | U | 3/2013 |
| CN | 103366706 | A | 10/2013 |
| CN | 103413533 | A | 11/2013 |
| CN | 104036722 | A | 9/2014 |
| CN | 104299569 | A | 1/2015 |
| CN | 104821152 | A | 8/2015 |
| CN | 104952409 | A | 9/2015 |
| CN | 105427823 | A | 3/2016 |
| JP | 2004212537 | A | 7/2004 |

OTHER PUBLICATIONS

The World Intellectual Property Organization (WIPO) International Search Report for PCT/CN2016/088180 dated Sep. 14, 2016 p. 1-13.

* cited by examiner

METHOD FOR ADJUSTING DRIVING VOLTAGE, RELATED ADJUSTING DEVICE AND DISPLAY DEVICE

CROSS-REFERENCES TO RELATED APPLICATIONS

This application is a national phase entry under 35 U.S.C. § 371 of International Application No. PCT/CN2016/088180, filed on Jun. 1, 2016, which claims priority of Chinese Patent Application No. 201610004275.1, filed on Jan. 4, 2016. The above enumerated patent applications are incorporated by reference herein in their entirety.

TECHNICAL FIELD

The present invention generally relates to the display technologies and, more particularly, relates to a method for adjusting a driving voltage, a related adjusting device, and a related display device.

BACKGROUND

Flat display devices such as thin-film transistor liquid crystal display (TFT-LCD) devices and active matrix organic light-emitting diode (AMOLED) display devices have been widely used in various industrial and civilian applications. Gate driving chips and source driving chips are often used in TFT-LCD devices and AMOLED devices for controlling the scanning of the pixel array and refreshing voltages for displaying images, respectively.

To use less printed circuit boards (PCBs) as the gate driving chips in a flat display device, propel link gate (PLG) wirings are used to mainly transmit signals outputted by a source driving circuit to a gate driving chip. PLG wirings are also used to transmit signals, e.g., power supply signals.

BRIEF SUMMARY

The present disclosure provides a method for adjusting a driving voltage, a related adjusting device, and a related display device. By using the method and devices provided by the present disclosure, the driving voltages for the gate driving circuit in a display device would be less susceptible to voltage-drops in the PLG wirings. Non-uniformities and failure during display may be reduced.

One aspect of the present disclosure includes a method for adjusting gate driving voltages for a gate driving circuit, output terminals of the gate driving circuit being connected with gate lines, an input terminal of the gate driving circuit being connected with a propel link gate (PLG) wiring. The method includes determining a voltage-drop value at an electrical connection point along the PLG wiring with respect to an input terminal of the PLG wiring, the electrical connection point connecting an input terminal of the gate driving circuit with the input terminal of the PLG wiring; and compensating the gate driving voltage on the input terminal of the gate driving circuit based on the voltage-drop value.

Optionally, compensating the gate driving voltage includes applying a compensated driving voltage on the input terminal of the PLG wiring, the compensated driving voltage being a gate driving voltage for driving a gate line.

Optionally, the compensated driving voltage is provided by an alternating current-direct current (AC-DC) power supply.

Optionally, determining the voltage-drop value at an electrical connection point along the PLG wiring with respect to an input terminal of the PLG wiring includes determining an equivalent resistance between the electrical connection point and the input terminal of the PLG wiring along the PLG wiring; and obtaining the voltage-drop value at the electrical connection point based on the equivalent resistance.

Optionally, the equivalent resistance of the electrical connection point corresponds to a distance from the electrical connection point to the input terminal of the PLG wiring.

Optionally, the voltage-drop value of the electrical connection point is proportional to the equivalent resistance from the input terminal of the PLG wiring to the electrical connection point.

Optionally, all input terminals of the gate driving circuit are connected to a common PLG wire, an equivalent resistance of adjacent electrical connection points is same.

Optionally, a period of outputting the compensated gate driving voltages for the input terminals of the gate driving circuit is same as a gate line scanning period.

Another aspect of the present disclosure provides a voltage adjusting device for adjusting driving voltages for a gate driving circuit, including: a processing unit for determining a voltage-drop value at an electrical connection point along a propel link gate (PLG) wiring with respect to an input terminal of the PLG wiring, the electrical connection point connecting an input terminal of the gate driving circuit with the input terminal of the PLG wiring; and an executing unit for compensating the driving voltage based on the voltage-drop value, and applying the compensated driving voltage on the input terminal of the PLG wiring for driving a gate line.

Optionally, the processing unit is further configured to: determine an equivalent resistance between the electrical connection point and the input terminal of the PLG wiring; and obtain the voltage-drop value at the electrical connection point based on the equivalent resistance.

Optionally, the executing unit provides the compensated driving voltage to the input terminal of the PLG wiring, and a period of outputting the compensated driving voltages being same as a gate line scanning period.

Optionally, the executing unit comprises an alternating current-direct current (AC-DC) power supply to apply the compensated driving voltage based on the voltage-drop value.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
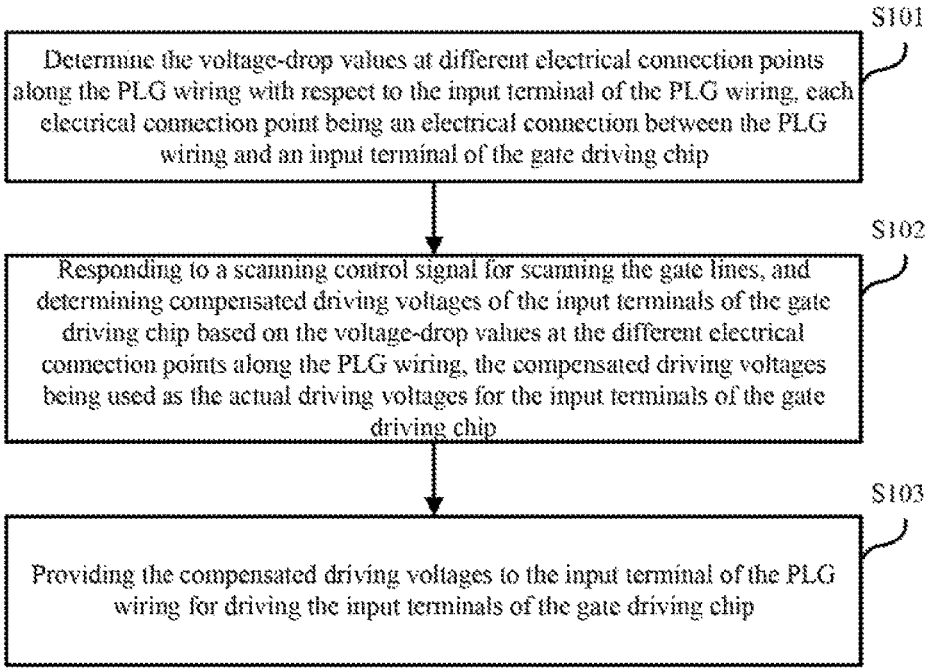
FIG. 1 illustrates an exemplary process of the method for adjusting a driving voltage according to various disclosed embodiments of the present disclosure.

For those skilled in the art to better understand the technical solution of the invention, reference will now be made in detail to exemplary embodiments of the invention, which are illustrated in the accompanying drawings. Wherever possible, the same reference numbers will be used throughout the drawings to refer to the same or like parts.

PLG wirings have impedances, which may cause an undesirably high voltage drop or IR-drop from an input terminal to a far end along a PLG wiring. Especially, for large-sized display panels, voltage-drops along the PLG wirings can be more prominent. For example, for a 55-inch display module, an output signal to a gate that is far away from the input terminal of a PLG wiring has an amplitude ranging from about −5 V to about 19 V. An output signal to a gate that is close to the input terminal of a PLG wiring has an amplitude ranging from about −5 V to about 22 V. As a result, voltage-drops in the conventional PLG wirings can cause noticeable differences in the power supply voltages provided to the connected gate driving circuit, which can further cause the driving voltages provided to the connected gate driving circuit to be different. The voltage-drops in the conventional PLG wirings can also cause the driving voltages applied on the input terminals of the gate driving circuit, which are far away from the input terminal of the PLG wiring, to be too low to drive the gate lines connected to the output terminals of the gate driving circuit. Images displayed by a display panel containing these gate driving circuits may lack uniformity or may fail to display.

In embodiments of the present disclosure, a voltage adjusting device may determine the voltage-drop values along the PLG wiring at electrical connection points and then compensate the driving voltages based on the corresponding voltage-drop values at the electrical connection points. The driving voltage, provided to the input terminals of the gate driving circuit or to the gate lines connected to the output terminals of the gate driving circuit, would thus be less susceptible to the voltage-drops along the PLG wirings. The driving voltage provided to each input terminal of the gate driving circuit may be substantially the same. Input terminals of the gate driving circuit, located far away from the input terminal of the PLG wirings, may function properly.

For example, the voltage adjusting device may first determine the voltage-drop values of different electrical connection points along a PLG wiring with respect to the input terminal of the PLG wiring. Each electrical connection point may be an electrical connection between the input terminal of the PLG wiring and an input terminal of a gate driving circuit, along the PLG wiring. The voltage adjusting device may then respond to a scanning control signal for scanning the gate lines and compensate the driving voltage based on the voltage-drop value at the electrical connection point of the input terminal of the gate driving circuit that is being scanned. The voltage adjusting device may then apply the compensated driving voltage on the input terminal of the PLG wiring.

One aspect of the present disclosure provides a method for adjusting a driving voltage.

FIG. 1 illustrates the disclosed method for adjusting a driving voltage. The method includes steps S101, S102, and S103.

In step S101, the voltage adjusting device may determine the voltage-drop values at different electrical connection points along the PLG wiring with respect to the input terminal of the PLG wiring. Each electrical connection point represents an electrical connection between the PLG wiring and an input terminal of a gate driving circuit. In the present disclosure, a voltage-drop value refers to the voltage value of a voltage-drop.

In step S102, the voltage adjusting device may respond to scanning control signals for scanning the gate lines, and determine compensated driving voltages for the gate driving circuit based on the voltage-drop values at the different electrical connection points along the PLG wiring. The compensated driving voltages, i.e., the driving voltages after compensation, may be used as the actual driving voltages for the gate driving circuit. In each frame, the voltage adjusting device may respond to the corresponding scanning control signal for scanning each gate line, and start calculating the compensated driving voltage based on the voltage-drop value at the corresponding electrical connection point, between the corresponding input terminal of the gate driving circuit that is being scanned and the input terminal of the PLG wiring.

In step S103, the display device may provide the compensated driving voltages to the input terminal of the PLG wiring for driving the input terminals of the gate driving circuit.

It should be noted that, in the present disclosure, the gate driving circuit may include anything proper components that need to be scanned in the operation of the display device. The term "driving the input terminals of the gate driving circuit" or the alike may refer to driving the gate lines, shift registers, or other parts included in the gate driving chip or connected to the output terminals of the gate driving circuit. Similarly, the "driving voltages for the gate driving circuit" may refer to the driving voltage applied on the input terminals of the gate driving circuit for driving the parts connected to or included in the gate driving circuit, such like driving voltages for the gate lines.

In the present disclosure, by determining the voltage-drop values along the PLG wiring at electrical connection points and then compensating the driving voltages based on the corresponding voltage-drop values at the electrical connection points, the driving voltage for the gate driving circuit would be less susceptible to the voltage-drops along the PLG wiring. Thus, the driving voltage provided to each input terminal of the gate driving circuit may be substantially the same, and gate lines located far away from the input terminal of the PLG wiring may function properly.

Often, a suitable power supply, e.g., an alternating current-direct current (AC-DC) power supply or a DC power source, may be used to provide power or the compensated driving voltages for the PLG wiring. A plurality of ways may be used to determine the voltage-drop values at different electrical connection points along the PLG wiring. For example, a feedback circuit may be used to detect the voltage at each electrical connection point and send the detected voltages as feedback to the AC-DC power supply. For cost and space considerations, in some embodiments, the equivalent circuit of the PLG wiring may be used to determine the equivalent resistance from the input terminal of the PLG wiring to each electrical connection point. The equivalent resistance from the input terminal of the PLG wiring to each electrical connection point may be used to determine the voltage-drop value at each electrical connection point. Specifically, to determine the voltage-drop values at different electrical connecting points along the PLG wiring from the input terminal of the PLG wiring, equivalent resistance from the input terminal of the PLG wiring to each electrical connection point may be determined. The voltage-drop values at different electrical connection points may be determined based on the calculated equivalent resistance at different electrical connection points.

Figure 2:
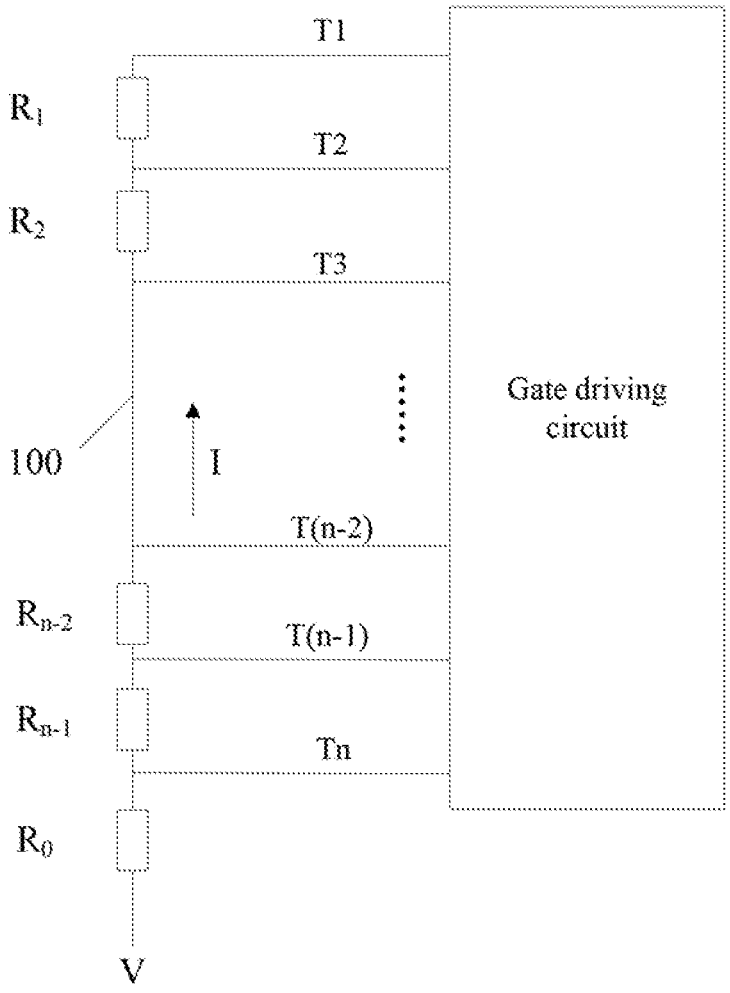
FIG. 2 illustrates an exemplary connection between a PLG wiring and a gate driving circuit according to various disclosed embodiments of the present disclosure.
Figure 3:
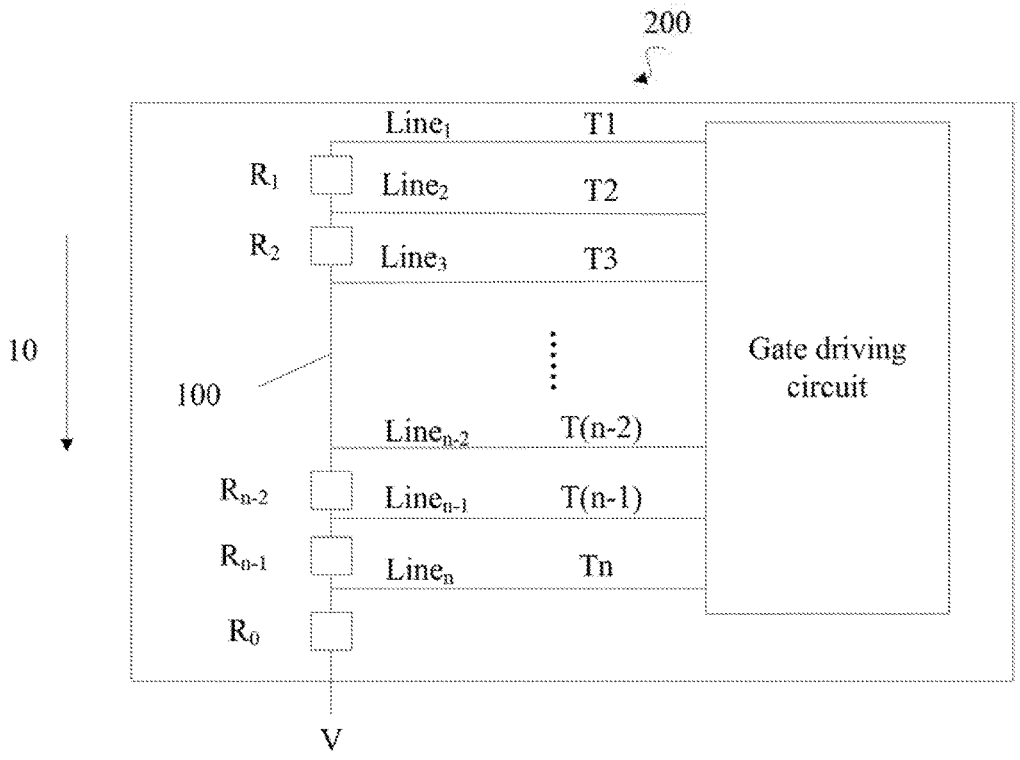
FIG. 3 illustrates an exemplary display panel according to various disclosed embodiments of the present disclosure.
Figure 4:
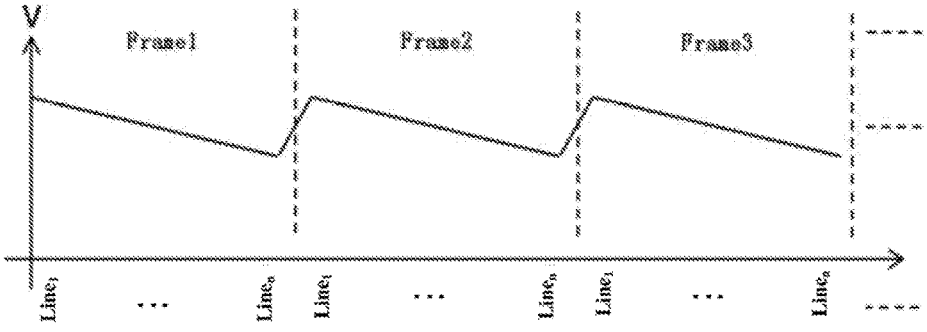
FIG. 4 illustrates actual driving voltages applied on an input terminal of the PLG wiring illustrated in FIG. 3.

FIG. 2 illustrates an exemplary equivalent circuit of the PLG wiring. The PLG wiring 100 may be equivalent to a plurality of resistors connected in series. The input terminal of the PLG wiring 100 may be connected to an AC-DC power supply V. A gate driving circuit may include a plurality of input terminals T1, T2, . . . , T(n−1), and Tn. The output terminals of the gate driving circuit may be connected to gate lines or other suitable parts that need to be driven according to a scanning sequence. The output terminals of the gate driving circuit and the parts connected to the output terminals are not shown in the figures. The input terminal of a gate driving circuit that is located farthest from the input terminal of the PLG wiring 100 may be the input terminal T1. The input terminals T1, T2, T3, . . . , T(n−2), T(n−1), and Tn, of the gate driving circuit, may be located from the farthest from to the closest to the input terminal of the PLG wiring 100, as shown in FIGS. 3 and 4. Input terminal T1 may be driven first by the PLG wiring 100 and input terminal Tn may be driven last by the PLG wiring 100.

In some embodiments, all input terminals of the gate driving circuit may be connected to a common PLG wiring 100. The equivalent resistors representing the resistance of the PLG wiring 100 may be $R_0$, $R_{n-1}$, $R_{n-2}$, . . . , $R_3$, $R_2$, and $R_1$. If the input terminals of the gate driving circuit, i.e., T1, T2, T3, . . . . , T(n−1), and Tn, are evenly distributed, the equivalent resistance between two adjacent electrical connection points may be considered the same. That is, equivalent resistors $R_0$, $R_{n-1}$, . . . , $R_2$, and $R_1$ may each be considered as a same substitute resistor $R_p$. For example, if the electric current is 1 and n equals 7, the voltage-drop value at the electrical connection points of input terminals T1, T2, T3, . . . , T(n−2), T(n−1), and Tn, may be $I(7R_p+R_0)$, $I(6R_p+R_0)$, $I(5R_p+R_0)$, . . . , $I(2R_p+R_0)$, $I(R_p+R_0)$, and $IR_0$, respectively.

Figure 5:
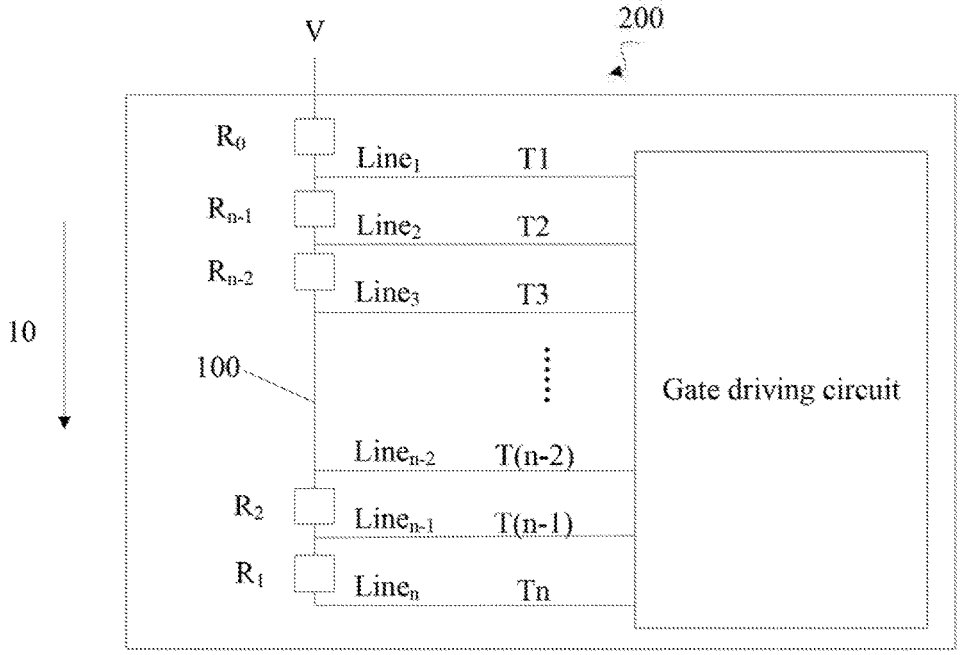
FIG. 5 illustrates another exemplary display panel according to various disclosed embodiments of the present disclosure.
Figure 6:
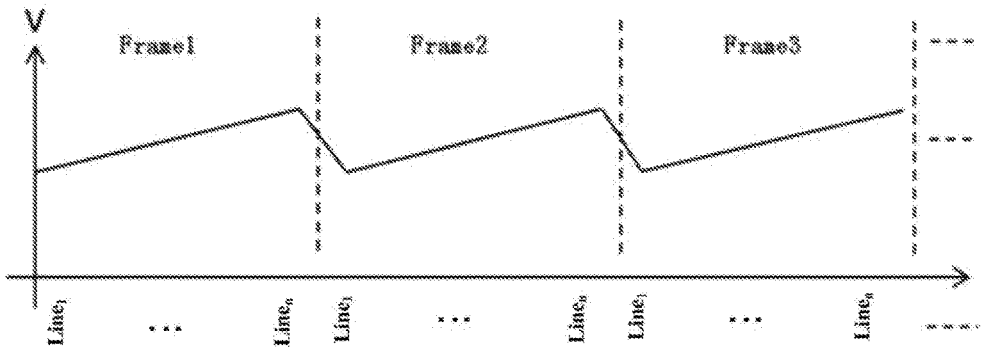
FIG. 6 illustrates actual driving voltages applied on an input terminal of the PLG wiring illustrated in FIG. 5.

If the AC-DC power supply V is arranged to be on the side of the input terminal T1, i.e., the input terminal T1 being the closest input terminal to the input terminal of the AC-DC power supply V and input terminal Tn being the farthest input terminal to the input terminal of the AC-DC power supply V, as shown in FIGS. 5 and 6, the input terminal T1 may be driven first by the PLG wiring 100 and the input terminal Tn may be driven last by the PLG wiring 100. Accordingly, the voltage-drop value from the input terminal of the PLG wiring 100 to the input terminal Tn may be the highest. The voltage-drop values may also be determined through the equivalent circuit of the PLG wiring 100, which are described previously. Details are not repeated herein.

As shown in FIG. 2, along the PLG wiring 100, the equivalent resistance at an electrical connection point increases from the electrical connection point closest to the input terminal of the PLG wiring to the electrical connection point farthest from the input terminal of the PLG wiring 100.

In some embodiments, the voltage-drop value from the input terminal of the PLG wiring 100 to an input terminal of the gate driving circuit may be proportional to the equivalent resistance from the input terminal of the PLG wiring to the electrical connection point.

It should be noted that, because gate line scanning, i.e., scanning of gate lines, are performed for displaying images, in some embodiments, the period to provide compensated driving voltages or driving voltages to the input terminal of the PLG wiring may be the same as the gate line scanning period. That is, the period the AC-DC power supply outputs the compensated driving voltages to the input terminals of the gate driving circuit may be the same as the gate line scanning period. In other words, the driving voltages or the compensated driving voltages applied on the input terminal of the PLG wiring may vary periodically, according to the gate line scanning frequency. Thus, the frequency of the driving voltage variation may be the same as the display frequency. The gate lines may be scanned in a progressive sequence, i.e., scanning row by row or line by line, or in an interlaced sequence, i.e., scanning every other row or every other line. The gate lines may be scanned in a suitable sequence, e.g., from the top to the bottom or from the bottom to the top of the gate lines. The AC-DC power supply may be control to provide the compensated driving voltages according to a same scanning sequence as the gate lines. In one embodiment, the gate lines and the input terminals of the gate driving circuit may be scanned from top to bottom along the scanning direction.

FIG. 3 illustrates an exemplary display panel 200 with PLG wiring. The input terminal Tn may be closest to the input terminal of the PLG wiring 100. Thus, the voltage-drop value from the input terminal of the PLG wiring to the input terminal Tn may be the lowest, and the voltage-drop value from the input terminal of the PLG wiring to the input terminal T1 may be the highest. The input terminal of the PLG wiring 100 may be connected to the AC-DC power supply V.

When the input terminals of the gate driving circuit, i.e., T1, T2, . . . , T(n−1), Tn, are scanned from top to bottom, i.e., scanned from T1 in $Line_1$ to Tn in $Line_n$ along the scanning direction 10, the profile or variation of the driving voltages provided to the gate driving circuit, i.e., from $Line_1$ to $Line_n$, may be shown in FIG. 4. The output terminals of the gate driving circuit connected gate lines, i.e., $Line_1$, $Line_2$, $Line_3$, . . . , $Line_{n-2}$, $Line_{n-1}$, $Line_n$, the input terminals of the gate driving circuit, i.e., T1, T2, . . . , T(n−1), Tn, corresponding to gate lines, i.e., $Line_1$, $Line_2$, $Line_3$, . . . , $Line_{n-2}$, $Line_{n-1}$, $Line_n$. The input terminal T1 may be driven first, and the input terminal Tn may be driven last. The voltage adjusting device may provide a highest driving voltage to the input terminal T1 that is farthest from the input terminal of the PLG wiring 100 and may provide a lowest driving voltage to the input terminal Tn that is closest to the input terminal of the PLG wiring 100.

In one frame, the driving voltage provided by the AC-DC power supply V may decrease as the line number increases, e.g., line number increasing from $Line_1$ to $Line_n$. For multi-frame display, the period of the driving voltage variation, shown by the plot in FIG. 4, may be the same as the gate line scanning period. Meanwhile, the period of the driving voltage variation may be the same as the display period. It should be noted that, when scanning the input terminals of the gate driving circuit in an interlaced sequence, in one period of the driving voltage variation, two voltage peaks may occur. Details are not described herein.

For example, the desired driving voltage for an input terminal of the gate driving circuit Tn (n=1, 2, 3, . . . , etc.) or the desired output voltage of $Line_n$ (n=1, 2, 3, . . . , etc.) may be VGG, and the driving voltage provided by the AC-DC power supply V at each time period, when responding to the scanning control signal of the corresponding gate line, may be VGH. In each frame, the voltage adjusting device may respond to a scanning control signal and scan the corresponding input terminal Tn according to a suitable sequence, e.g., progressive or interlaced, along the scanning direction. When scanning each input terminal Tn in one period, the voltage-drop value, e.g., ΔV, at the electrical connection point of the input terminal Tn, may be determined, and the voltage adjusting device may output a compensated driving voltage or driving voltage, i.e., VGH=(VGG+ΔV), to the input terminal of the PLG wiring 100 to drive the input terminal Tn or the corresponding gate line. The compensation voltage value AC-DC power supply V provides to the input terminal Tn, which is being scanned, is thus ΔV. Depending on the distance from the input terminal of the PLG wiring to the input terminal Tn, the voltage-drop value ΔV or the compensation voltage value may change accordingly. That is, if the input terminals Tn of the gate driving circuit are evenly distributed along the scanning direction 10, and the equivalent resistance between two adjacent input terminals is $R_p$, the voltage-drop value ΔV may change linearly. In other words, the compensation voltage value the AC-DC power supply V provides to the input terminals of the gate driving circuit along the scanning direction 10 may change linearly while VGG is a fixed value. Thus, along the scanning direction, the driving voltages the AC-DC power supply V provides to the gate driving circuit in one frame may have a linearly trend.

FIGS. 3 and 4 illustrate the display panel 200 with the compensated driving voltage varying in a linearly trend. The input terminal T1 may be located the farthest from the input terminal of the PLG wiring 100 or the AC-DC power supply V, so that the input terminal T1 may be driven first and the compensation voltage value ΔV provided to the input terminal T1 may be the highest. The input terminal Tn may be located the closest to the input terminal of the PLG wiring 100 or the AC-DC power supply V, so that the input terminal Tn may be driven last and the compensation voltage value ΔV provided to the input terminal Tn may be the lowest. The compensation voltage value ΔV provided to an input terminal between T1 and Tn may be between the highest value and the lowest value of ΔV and may change linearly. Thus, the compensated driving voltage the AC-DC power supply V provides to the input terminals of the gate driving circuit along the scanning direction, i.e., (VGG+ΔV), may also have a linear trend, as shown in the plot of FIG. 4.

Thus, the voltage adjusting device may control the AC-DC power supply V to compensate the driving voltage for each input terminal of the gate driving circuit in accordance with the distance from the input terminal of the PLG wiring 100 to the input terminal Tn being scanned. The compensation voltage value ΔV may change according to the distance between each electrical connection point and the input terminal of the PLG wiring 100 along the PLG wiring 100. After the compensation, the output voltage or the driving voltage for each input terminal Tn may be at least substantially close to VGG. That is, the driving voltage for each input terminal Tn may be properly compensated, and each input terminal Tn may be operated under the desired driving voltage.

FIG. 5 illustrates another exemplary display panel 200) with PLG wiring 100. The input terminal T1 may be closest to the input terminal of the PLG wiring 100. Thus, the voltage-drop value from the input terminal of the PLG wiring to the input terminal T1 of the gate driving circuit may be the lowest, and the voltage-drop value from the input terminal of the PLG wiring 100 to the input terminal Tn of the gate driving circuit may be the highest. The input terminal of the PLG wiring 100 may be connected to the AC-DC power supply V.

When the input terminals of the gate driving circuit, i.e., T1, T2, . . . , T(n−1), and Tn, are scanned from top to bottom, i.e., scanned from input terminal T1 in $Line_1$ to input terminal Tn in $Line_n$ as the scanning direction 10, the output terminals of the gate driving circuit connected gate lines, i.e., $Line_1$, $Line_2$, $Line_3$, . . . , $Line_{n-2}$, $Line_{n-1}$, $Line_n$, the input terminals of the gate driving circuit, i.e., T1, T2, . . . , T(n−1), Tn, corresponding to gate lines, i.e., $Line_1$, $Line_2$, $Line_3$, . . . , $Line_{n-2}$, $Line_{n-1}$, $Line_n$. The profile of the driving voltages provided to the gate driving circuit, i.e., from $Line_1$ to $Line_n$, may be shown in FIG. 6. The display panel 200 may provide a lowest driving voltage to the input terminal T1 closest from the input terminal of the PLG wiring 100 and may provide a highest driving voltage to the input terminal Tn farthest from the input terminal of the PLG wiring 100. In one frame, the driving voltage provided by the AC-DC power supply V may increase as the row number increases, e.g., row number increasing from $Line_1$ to $Line_n$. For multi-frame display, the period of the driving voltage variation, shown by the plot in FIG. 6, may be the same as the gate line scanning period. Meanwhile, the period of the driving voltage variation may be the same as the display period. It should be noted that, when scanning the input terminals of the gate driving circuit in an interlaced sequence, in one period of the driving voltage variation, two voltage peaks may occur. Details are not described herein. Details of the working principles are described in FIGS. 3 and 4 and are not repeated herein.

In the present disclosure, by determining the voltage-drop values at different electrical connection points along the PLG wiring and compensating the driving voltage for each input terminal of the gate driving circuit, the driving voltage provided to each input terminal would be less susceptible to voltage-drops of the PLG wiring. Thus, the driving voltage provided to each input terminal of the gate driving circuit would be at least substantially the same and close to a desired driving voltage. Gate lines located far away from the input terminal of the PLG wiring may function properly. Issues such as non-uniformities or failure during display, caused by the voltage-drop of PLG wiring, may be reduced or eliminated.

Another aspect of the present disclosure provides a voltage adjusting device 300.

Figure 7:
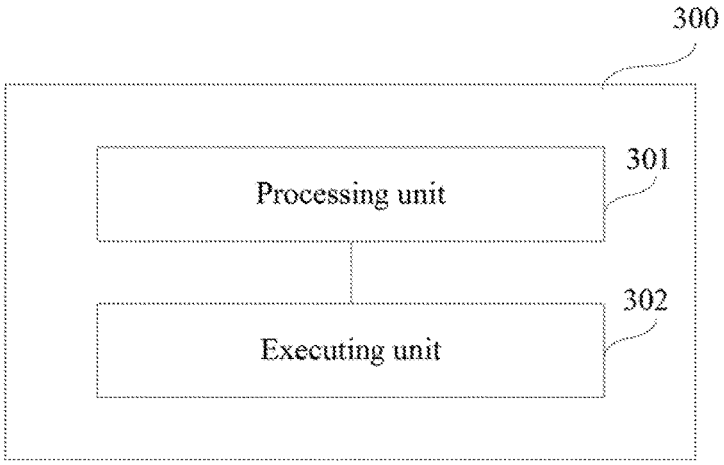
FIG. 7 illustrates an exemplary adjusting device according to various disclosed embodiments of the present disclosure.

FIG. 7 illustrates an exemplary block diagram of the voltage adjusting device 300. The voltage adjusting device 300 may include a processing unit 301 and an executing unit 302.

The processing unit 301 may determine the voltage-drop values of different electrical connection points along the PLG wiring with respect to the input terminal of the PLG wiring. Each electrical connection point may be an electrical connection between the PLG wiring and an input terminal of a gate driving circuit.

The executing unit 302 may respond to a scanning control signal for scanning gate lines to scan the input terminals of the gate driving circuit and compensate the driving voltage based on the voltage-drop value at the electrical connection point of the input terminal that is being scanned. The executing unit 302 may also include an AC-DC power supply to apply a compensated driving voltage on the input terminal of the PLG wiring to drive each input terminal of the gate driving circuit or the corresponding gate line. The compensated driving voltage for an input terminal may be based on the voltage-drop value at the corresponding electrical connection point.

In some embodiments, the processing unit 301 may determine the equivalent resistance at different electrical connection point along the PLG wiring with respect to the input terminal of the PLG wiring. The PLG wiring may further determine the voltage-drop value at each electrical connection point along the PLG wiring based on the equivalent resistance at each electrical connection point.

In some embodiments, the executing unit 302 may provide an actual driving voltage or a compensated driving voltage to the gate driving circuit that is being scanned. The profile or curve formed by the compensated driving voltages for the input terminals of the gate driving circuit, each provided at the input terminal of the PLG wiring a different time during a frame, may have a period same as the gate line scanning period.

Figure 9:
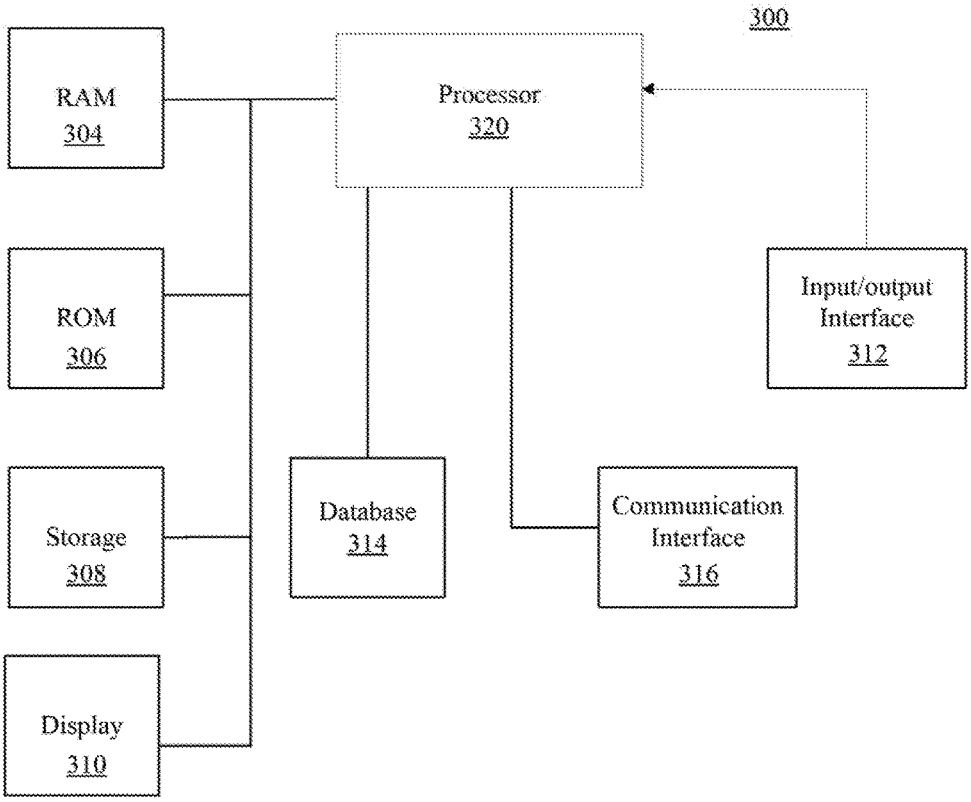
FIG. 9 illustrates an exemplary block diagram of the voltage adjusting device according to various disclosed embodiments of the present disclosure.

FIG. 9 illustrates a block diagram of different parts in the voltage adjusting device 300, used in various embodiments of the present disclosure.

The voltage adjusting device 300 may receive, process, and execute commands from the display device. The voltage adjusting device 300 may include any appropriately configured computer system. As shown in FIG. 9, the voltage adjusting device 300 may include a processor 320, a random access memory (RAM) 304, a read-only memory (ROM) 306, a storage 308, a display 310, an input/output interface 312, a database 314; and a communication interface 316. Other components may be added and certain devices may be removed without departing from the principles of the disclosed embodiments. Various combinations of the pans in the voltage adjusting device 300 may be configured to implement the functions of a processing unit 301 and an executing unit 320 illustrated in FIG. 7.

Processor 320 may include any appropriate type of general purpose microprocessor, digital signal processor or microcontroller, and application specific integrated circuit (ASIC). Processor 320 may execute sequences of computer program instructions to perform various processes associated with voltage adjusting device 300. Computer program instructions may be loaded into RAM 304 for execution by processor 320 from read-only memory 306, or from storage 308. Storage 308 may include any appropriate type of mass storage provided to store any type of information that processor 320 may need to perform the voltage adjusting processes. For example, storage 308 may include one or more hard disk devices, optical disk devices, flash disks, or other storage devices to provide storage space.

Display 310 may provide information to a user or users of the voltage adjusting device 300. Display 310 may include any appropriate type of computer display device or electronic device display (e.g., CRT or LCD based devices). Input/output interface 312 may be provided for users to input information into adjusting device 300 or for the users to receive information from adjusting device 300. For example, input/output interface 312 may include any appropriate input device, such as a keyboard, a mouse, an electronic tablet, voice communication devices, touch screens, or any other optical or wireless input devices. Further, input/output interface 312 may receive from and/or send data to other external devices.

Further, database 314 may include any type of commercial or customized database, and may also include analysis tools for analyzing the information in the databases. Database 314 may be used for storing information for determining the equivalent circuit, equivalent resistance, and Voltage-drops of the PLG wiring. Communication interface 316 may provide communication connections such that the voltage adjusting device 300 may be accessed remotely and/or communicate with other systems through computer networks or other communication networks via various communication protocols, such as transmission control protocol/internet protocol (TCP/IP), hyper text transfer protocol (HTTP), etc.

In one embodiment, in one frame, the processor 320 may calculate the voltage-drop values at different electrical connection points along the PLG wiring based on circuit information of the PLG wiring stored in the RAM 304, the ROM 306, and/or the storage 308. The processor 320 may respond to the scanning control signal when scanning an input terminal of a gate driving circuit, and compensate the driving voltage for the gate driving circuit based on the voltage-drop value at the gate driving circuit that is being scanned. Through the input/output interface 312, the processor 320 may apply the compensated driving voltage at the input terminal of the PLG wiring so that the compensated driving voltage may be the actual driving voltage for the input terminal of the gate driving circuit. The processor 320 may apply a suitable compensated driving voltage on the input terminal of the PLG wiring for each gate driving circuit according to a suitable scanning sequence and a suitable scanning direction. Thus, the driving voltages for the gate driving circuit along the scanning direction may be operated under a same driving voltage, and non-uniformities or failure during display may be reduced.

Another aspect of the present disclosure provides a display device.

Figure 8:
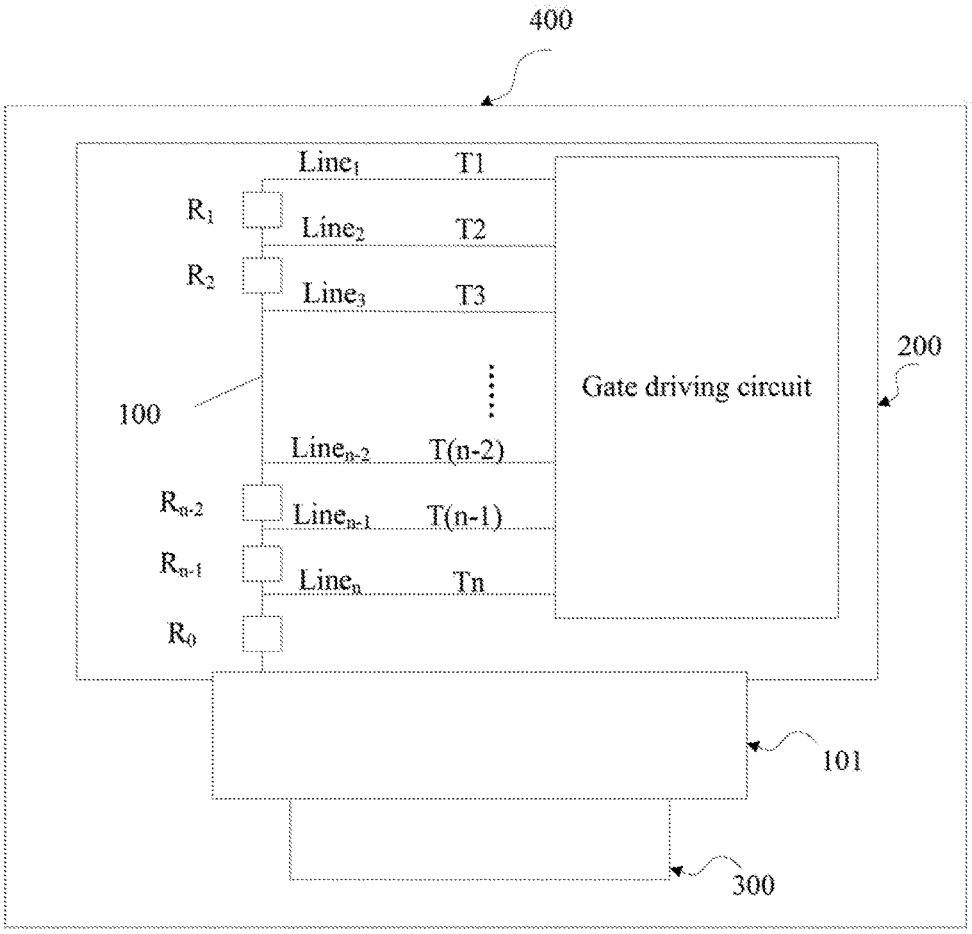
FIG. 8 illustrates an exemplary display device according to various disclosed embodiments of the present disclosure.

FIG. 8 illustrates an exemplary display device 400 provided by the present disclosure. The display device 400 may include the disclosed display panel 200. The display panel 200 may include a PLG wiring and a plurality input terminals of a gate driving circuit, e.g., T1, T2, . . . , T(n−1), and Tn. An electrical connection point on the PLG wiring 100 may be electrically connected to an input terminal of the gate driving circuit. The disclosed voltage adjusting device 300 may also be included in the display device 400 for controlling and executing desired commands such that the display panel 200 may display images with reduced non-uniformities and failure.

The voltage adjusting device 300 may be connected or attached to the display device 200 through a circuit on film (COF) 101. Details of the COF connection is not repeated herein.

It should be noted that, the circuit structures in the present disclosure are only exemplary. Other suitable circuits, with similar or related structures, voltage-drops along certain wirings may also be compensated using the disclosed method. In addition, the compensated voltage values may be preset or may be determined according to suitable feedback mechanism. The specific methods to compensate the voltage-drops should not be limited by the embodiments of the present disclosure.

In the present disclosure, by determining the voltage-drop values at different electrical connection points along a PLG wiring and compensating the driving voltage for each input terminal of a gate driving circuit, the driving voltage provided to each input terminal would be less susceptible to voltage-drops of the PLG wiring. Thus, the driving voltage provided to each input terminal and/or each gate line would be at least substantially the same and/or close to a desired driving voltage. Gate lines located far away from the input terminal of the PLG wiring may function properly. Issues such as non-uniformities or failure during display, caused by the voltage-drops of PLG wiring, may be reduced or eliminated.

It should be understood that the above embodiments disclosed herein are exemplary only and not limiting the scope of this disclosure. Without departing from the spirit and scope of this invention, other modifications, equivalents, or improvements to the disclosed embodiments are obvious to those skilled in the art and are intended to be encompassed within the scope of the present disclosure.

What is claimed is:

1. A method for adjusting a gate driving voltage for a gate driving circuit, output terminals of the gate driving circuit being connected with gate lines, input terminals of the gate driving circuit being connected with a propel link gate (PLG) wiring, comprising:

determining an equivalent resistance between an electrical connection point and an input terminal of the PLG wiring along the PLG wiring, wherein:

the electrical connection point connects an input terminal of the gate driving circuit with the input terminal of the PLG wiring, and the equivalent resistance of the electrical connection point corresponds to a distance from the electrical connection point to the input terminal of the PLG wiring;

obtaining a voltage-drop value at the electrical connection point based on the equivalent resistance; and compensating the gate driving voltage on the input terminal of the gate driving circuit based on the voltage-drop value.

2. The method according to claim 1, wherein compensating the gate driving voltage comprises:

applying a compensated driving voltage on the input terminal of the PLG wiring, the compensated driving voltage being a gate driving voltage for driving a gate line.

3. The method according to claim 2, wherein the compensated driving voltage is provided by an alternating current-direct current (AC-DC) power supply.

4. The method according to claim 1, wherein: the voltage-drop value of the electrical connection point is proportional to the equivalent resistance from the input terminal of the PLG wiring to the electrical connection point.

5. The method according to claim 4, wherein all the input terminals of the gate driving circuit are connected to a common PLG wire, and an equivalent resistance of adjacent electrical connection points is same.

6. The method according to claim 1, wherein: a period of outputting a compensated gate driving voltage on the input terminal of the gate driving circuit is same as a gate line scanning period.

7. A voltage adjusting device for adjusting driving voltages for a gate driving circuit, comprising:

a processing unit configured for:

determining equivalent resistance between an electrical connection point and an input terminal of a propel link gate (PLG) wiring along the PLG wiring, wherein:

the electrical connection point connects an input terminal of the gate driving circuit with the input terminal of the PLG wiring, and the equivalent resistance of the electrical connection point corresponds to a distance from the electrical connection point to the input terminal of the PLG wiring; and obtaining a voltage-drop value at the electrical connection point based on the equivalent resistance; and an executing unit configured for compensating the driving voltage based on the voltage-drop value, and applying the compensated driving voltage on the input terminal of the PLG wiring for driving a gate line.

8. The voltage adjusting device according to claim 7, wherein the executing unit is further configured for applying the compensated driving voltage to the input terminal of the PLG wiring, and a period of outputting the compensated driving voltage being same as a gate line scanning period.

9. The voltage adjusting device according to claim 8, wherein the executing unit comprises an alternating current-direct current (AC-DC) power supply to apply the compensated driving voltage based on the voltage-drop value.

* * * * *